United States Patent [19]

Marshall

[11] Patent Number: 4,970,631

[45] Date of Patent: Nov. 13, 1990

[54] HEADBAND DEVICE FOR HOLDING FLASHLIGHT

[76] Inventor: Timothy E. Marshall, 216 First Ave., West Berlin, N.J. 08091

[21] Appl. No.: 502,855

[22] Filed: Apr. 2, 1990

[51] Int. Cl.[5] ..... F21L 15/14

[52] U.S. Cl. ..... 362/105; 362/190; 362/191; 362/804

[58] Field of Search ..... 362/103, 105, 106, 157, 362/190, 191, 418, 804

[56] References Cited

U.S. PATENT DOCUMENTS

| | | | |
|---|---|---|---|
| 2,263,577 | 11/1941 | Griner | 240/59 |
| 2,421,643 | 6/1947 | Ostli | 362/106 |
| 2,765,398 | 10/1956 | Mays | 362/105 |
| 3,249,271 | 5/1966 | Allbritton | 224/25 |
| 3,769,663 | 11/1973 | Perl | 362/105 |
| 3,830,230 | 8/1974 | Chester | 362/105 |
| 4,360,930 | 11/1982 | Blanchard | 2/209.2 |
| 4,462,064 | 7/1984 | Schweitzer | 362/105 |
| 4,718,126 | 1/1988 | Slay | 2/175 |
| 4,794,496 | 12/1988 | Lanes et al. | 362/105 |
| 4,797,793 | 1/1989 | Fields | 362/105 |
| 4,887,194 | 12/1989 | Fields | 362/105 |

FOREIGN PATENT DOCUMENTS

| | | | |
|---|---|---|---|
| 1370623 | 7/1964 | France | 362/103 |
| 503368 | 4/1939 | United Kingdom . | |

*Primary Examiner*—Ira S. Lazarus
*Assistant Examiner*—Sue Hagarman
*Attorney, Agent, or Firm*—Thomas A. Lennox

[57] ABSTRACT

A device for holding a miniature high intensity flashlight along the side of the person's head to direct the beam of light in a path vertically positioned at the line of sight of the individual wearing the device. The device includes an elastic strap with overlapping ends held together with VELCRO® attachments with a tubular strap through which the body of the flashlight is inserted and held in position on the strap. The rear end of the flashlight is held with VELCRO® attachment or a corrugated spring clip against an inclined bearing surface block holding the end of the flashlight away from the person's head and allowing the rear end of the flashlight to be fixed to the bearing surface of that block at any height.

18 Claims, 2 Drawing Sheets

HEADBAND DEVICE FOR HOLDING FLASHLIGHT

BACKGROUND OF THE INVENTION

This invention involves a device holding a small flashlight to the head of a person directing the beam of light along the line of sight of the individual.

It has long been a problem to provide light to a work site that a person can reach, without using one of the person's hands to hold the flashlight. Flood lights and even work lights on the end of a cord are difficult to support and direct the light in exactly the needed direction. While it is possible to provide light to a general area, it is difficult to avoid shadows caused by the person's head, body or even hands of the person carrying out the task. Various devices have been provided to hold flashlights to the head of the person doing the task. These have included lamps fixed to the forehead of the person by strap and have also included attaching small flashlights to the side of the head, above the ear of the person with the light beam directed generally forwardly.

These latter devices, typically direct the light in a line generally parallel with the line of sight of the individual. That type of device requires that the person tilt his or her head sideways in order to get the light to the proper point and then view the object of interest out of the corner of one's eyes. Further, these latter devices do not provide means for adjusting, fixing and holding the flashlight in any chosen direction in a vertical plane intersecting with the line of sight of the individual wearing the device.

These prior art devices do not satisfy these needs nor attain the objects described herein below.

SUMMARY OF THE INVENTION

It is an object of the present invention to provide a device and method which will hold a common small cylindrical flashlight on a person's head to direct the light in any chosen direction within the field of vision of the person wearing the light.

It is a particular object of the present invention to provide a device which can allow the attachment and holding of flashlights of varying sizes to the head of a person with the ability to direct the light upwardly or downwardly in a plane to the chosen area of illumination.

It is an additional object of the present invention to provide a strap together with a holding device interfitting around the flashlight to hold it to the side of the head above the ear of the person, with the device including means to hold the rear of the flashlight away from the head and direct the beam of the flashlight toward the line of vision of the person looking straight ahead, rather than parallel to that line of vision.

It is a particular object of the present invention to combine the means to hold the rear of the flashlight away from the head to direct the light beam more directly toward the line of vision when the person is looking straight ahead and the means to adjust the direction of the flashlight beam upwardly or downwardly by attachment of the rear of the flashlight at various heights.

It is an additional object of the present invention to provide a device holding the flashlight above the ear of the person which securely fastens the rear of the flashlight at varying heights to adjust the angle of direction of the light beam emanating from the front of the flashlight.

This invention is a device to hold a flashlight on the head of a person. The type of flashlight includes a tubular body, a front end from which a beam of light is emitted and a rear opposite end. The device includes a strap to fit around the person's head and a first means to adjust the size of the strap to firmly hold the strap horizontally around the person's head above the person's eyes. The device further includes holding means on the strap to hold the flashlight to the strap in a generally horizontal position on a side of the person's head. The device also includes a member attached to the strap that includes an essentially vertical bearing surface facing away from the strap. The member is positioned rearwardly of the holding means a sufficient distance to allow the rear end of the flashlight to rest on the bearing surface when the flashlight is held in the holding means. The device further includes vertical adjustment means to hold the rear end of the flashlight in any chosen position vertically on the bearing surface of the member.

It is preferred that the strap be elastic and that the first means include two ends of the strap overlapping each other together with complimentary hook and loop fabric surface attachment swatches, such as Velcro swatches, attached on mating overlapping ends of the strap. It is also preferred that the holding means include a band having two ends and a median section, which is attached to the strap in a vertical alignment, and that the holding means further include complimentary hook and loop fabric surface attachment swatches attached on opposite sides of the band and on opposite ends of the band. It is also preferred that the member be a block of rigid flexible polymeric plastic foam and that the bearing surface be sloped frontwardly toward the strap in relation to the outside surface of the strap. It is further preferred that the member include a horizontal width sufficient to place the bearing surface a sufficient distance from the strap that the flashlight beam is focusable at a point on the line of sight of the person looking straight ahead. It is also preferred that the vertical adjustment means include a hook or loop fabric surface attachment swatch attached on the bearing surface of the member, and a complimentary hook or loop fabric surface attachment swatch attached on the rear end of the flashlight. It is further preferred that the flashlight include a projection from the rear end with a hole through the projection, and that the vertical adjustment means include a metal member formed in a corrugated pattern on one exposed end of a size and shape to interfit into the hole in the flashlight projection and further be attached in a vertical alignment to the member abutting the bearing surface. It is also preferred that member be attached to the strap rearwardly of the holding means a sufficient distance to allow the rear end of the flashlight to rest on the bearing surface when the flashlight is held in the holding means, and that the member include an essentially vertical bearing surface facing away from the strap member positioned a sufficient horizontal distance from the strap that the flashlight beam is focusable at a point on the line of sight of the person looking straight ahead.

The invention is also a method to hold a flashlight on the head of a person, the flashlight including a tubular body, a front end from which a beam of light is emitted and a rear opposite end. The method includes fitting a strap around the person's head and adjusting the size of the strap to firmly hold the strap horizontally around the person's head above the person's eyes. The method further includes detachably attaching the flashlight to the strap using a holding means on the strap, the alignment of the flashlight being in a generally horizontal position on a side of the person's head. The method also includes resting the rear end of the flashlight on an essentially vertical bearing surface of a member attached to the strap rearwardly of the holding means, the position of bearing surface of the member being a sufficient distance to allow the rear end of the flashlight to rest on the bearing surface while the flashlight is held in the holding means. The method further includes focusing the flashlight beam at a point on the line of sight of the person looking straight ahead, wherein the vertical bearing surface facing away from the strap member is positioned a sufficient horizontal distance from the strap to allow said focusing. The method also includes vertically adjusting the focus of the flashlight means by detachably attaching the rear end of the flashlight in any chosen position vertically on the bearing surface of the member.

It is preferred that the flashlight include a projection from the rear end with a hole through the projection, and the vertically adjusting the focus include attaching a metal member with a section formed in a corrugated pattern proximate an exposed end, the section being attached in a horizontal alignment abutting the bearing surface, and vertical adjusting further include interfiting the end and the section into the hole in the flashlight projection. It is also preferred that the vertically adjusting of the focus of the flashlight include attaching a hook or loop fabric surface attachment swatch attached on the rear end of the flashlight to a complimentary hook or loop fabric surface attachment swatch on the bearing surface of the member.

DESCRIPTION OF PREFERRED EMBODIMENTS

Figure 1:
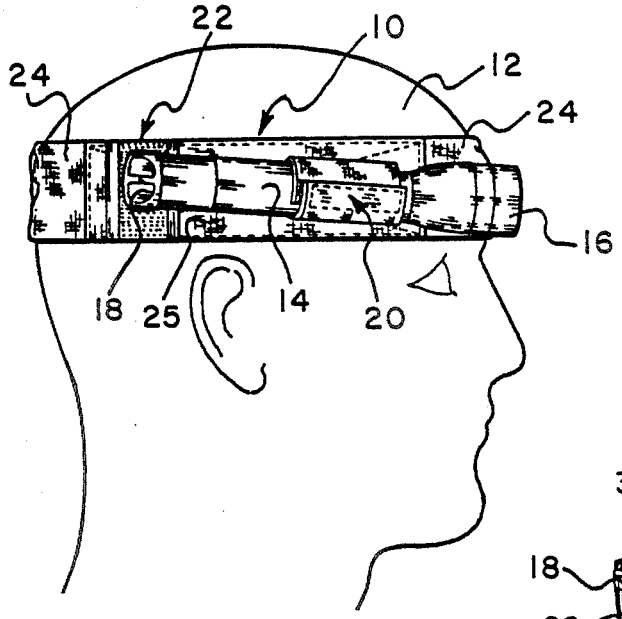
FIG. 1 is a right side elevational view of a device of the present invention secured on the head of a person showing the side of the head with the flashlight held above the person's ear.
Figure 2:
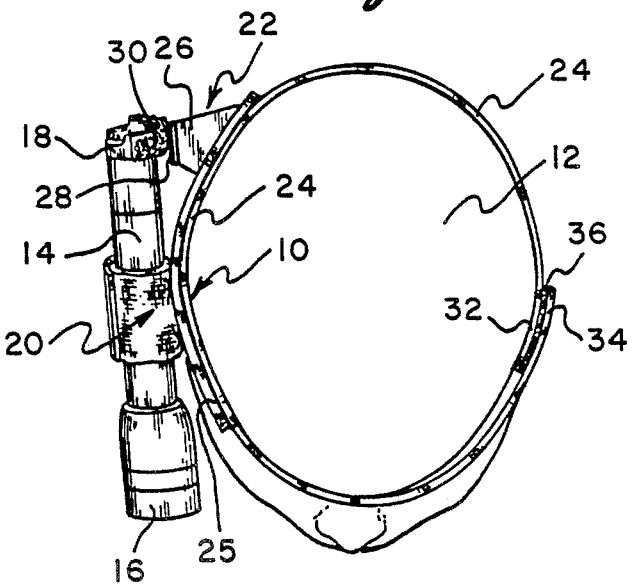
FIG. 2 is a top plan view looking down on the device attached around the person's head.
Figure 4:
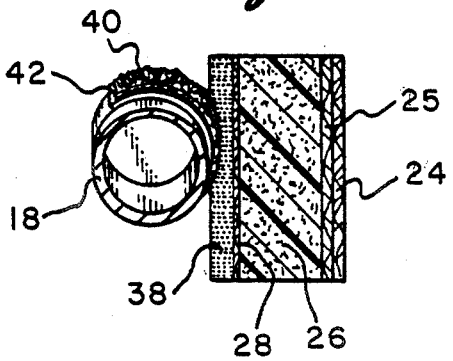
FIG. 4 is a cross-sectional view taken along lines 4—4 of FIG. 3.
Figure 3:
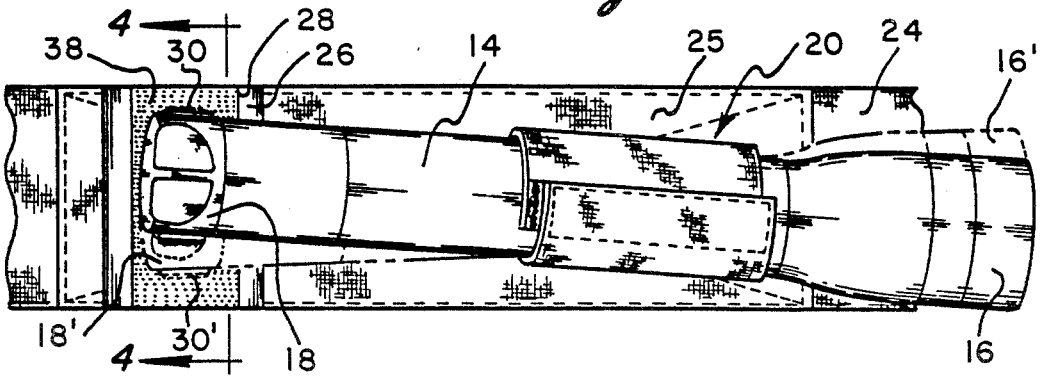
FIG. 3 is an enlarged elevational view of a cut-away section of the device illustrated in FIG. 1, illustrating the adjustment of the direction of vertical adjustment in the beam direction of the flashlight using the device.

In FIG. 1, device 10 is shown attached to a person's head 12 above the eyes and above the ear of the person. Flashlight 14 is a standard cylindrical high intensity flashlight of miniaturized design, typically of a length about three to seven inches long and being powered with either "AA" or "AAA" sized batteries. Flashlight 14 includes front end 16 from which the light beam emanates and rear section 18 which usually includes a screw threaded cap for removal and replacement of batteries. Device 10 includes elastic cloth strap 24 of sufficient size to encircle a person's head on which is attached holding device 20 which encircles and holds the body of flashlight 14. Also attached to strap 24 is adjustment device 22 which not only holds rear section 18 of flashlight 14, but also allows that attachment to be at different heights, thus allowing the vertical position of head 16 of the flashlight 14 to be vertically adjusted and the light beam held in any chosen direction. Both holding device 20 and adjustment device 22 are attached to reinforcement section 25 which is attached to strap 24. Reinforcement section 25 is a nonelastic cloth patch sewn onto strap 24. As further shown in FIG. 2, rear block member 26 is a block of semi-rigid polymeric plastic foam adhesively attached to section 25 and extending outwardly from the strap and from the head of the person wearing the strap in a horizontal direction. This distance and shape of block 26 is sufficient to place vertical bearing surface 28 at a position away from the strap and away from the head of the person wearing it, such that rear end 18 of flashlight 14 is held away from the head a sufficient distance to aim the flashlight beam in a vertical plane to intersect the line of vision within arm's length of the person wearing the device when the person is looking straight ahead. This allows the beam to directly illuminate a work site which can be reached by the person wearing the device. Loop VELCRO® swatch 30 is adhesively attached around a side of rear end 18 of flashlight 14. Swatch 30 detachable attaches to hook VELCRO® swatch 38 adhesively attached to bearing surface 28 as shown in FIGS. 3 and 4. Strap 24 also includes overlapping ends 32 and 34, with the adjacent abutting surfaces of these overlapping ends being equipped with VELCRO® attachment 36 which includes a hook VELCRO® swatch on one surface and a loop VELCRO® swatch on the other abutting end surface. The length of VELCRO® attachment 36 is sufficient to allow for differing head sizes, which coupled with the elastic nature of strap 24, provides for size adjustment and comfort. As shown in FIG. 3, hook VELCRO® swatch 38 is adhesively attached on bearing surface 28 on the outside of member 26. Loop VELCRO® swatch 30 adhesively attached around end 18 is mostly hidden in this view and is attached to surface 38 positioning end 18 somewhat upwardly on surface 28 thus directing front end 16 of flashlight 14 generally downwardly. The shadowed lines show the rear end of flashlight 14, designated 18' moved downwardly and attached through loop VELCRO® swatch 30' to a lower position on bearing surface 28 to hook VELCRO® swatch 38. This attachment of the rear end of the flashlight at position 18' directs the front end 16' of the flashlight in a somewhat upwardly direction. In FIG. 4, the cross-sectional view shows the construction and attachment of the elements proximate the rear of section 25. Reinforcement section 25 is stitchably attached to elastic strap 24. Block member 26 is adhesively attached to the cloth of section 25 and hook VELCRO® swatch 38 is adhesively attached on vertical bearing surface 28 of member 26. Loop VELCRO® swatch 40 is attached by two-sided adhesive strip 42 around the outside surface of the rear section 18 of flashlight 14. Loop VELCRO® 40 is then detachably attached at any position on the face of hook VELCRO® swatch 38.

Figure 5:
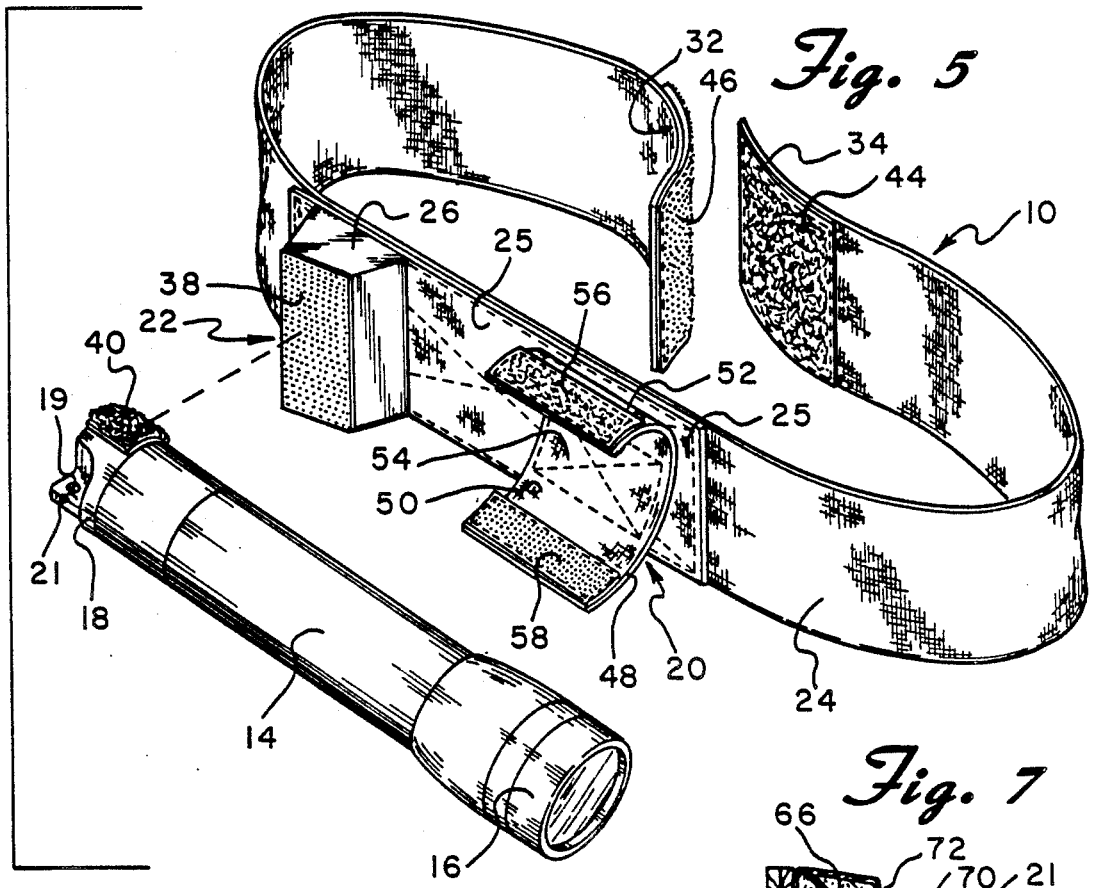
FIG. 5 is an exploded perspective view of the device illustrated in FIGS. 1 and 2 showing the flashlight removed from the device.

As illustrated in FIG. 5, end 32 of strap 24 is equipped with hook VELCRO® swatch 46 while end 34 is equipped with loop VELCRO® swatch 44. The sides of strap 24 of attachment of the VELCRO® swatches are chosen so that they abut each other when the ends are overlapped. Holding device 20 is constructed of cloth strap 48 with inside surface 50 and outside surface 52, the latter being mostly hidden in this view. Outside surface 52 abuts the outside surface of reinforcement section 25 while inside surface abuts the barrel of flashlight 14 when strap 48 is wrapped around and is holding the flashlight. Median section 54 of strap 48 is stitchably attached to section 25 forwardly of the position of attachment of member 26 leaving free ends of strap 48. These free ends overlap with the outside surface 52 being equipped on one end with loop VELCRO® swatch 56 and the other end being equipped on inside surface 50 with hook VELCRO® swatch 58. Both of these VELCRO® swatches are stitchably attached to the ends of strap 48. In this embodiment, the barrel of flashlight 14 is placed on inside surface 50 with the ends of strap 48 encircling the body of the flashlight with VELCRO® strips 56 and 58 abutting each other and attaching to each other to hold the flashlight in place.

Figure 7:
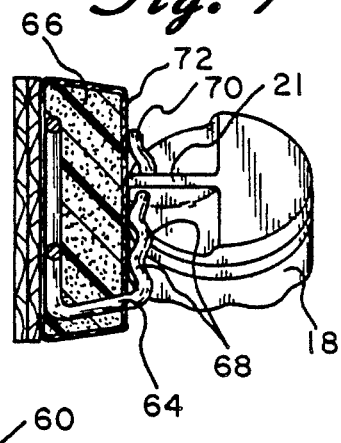
FIG. 7 is a cross-sectional view taken along lines 7—7 of FIG. 6.
Figure 6:
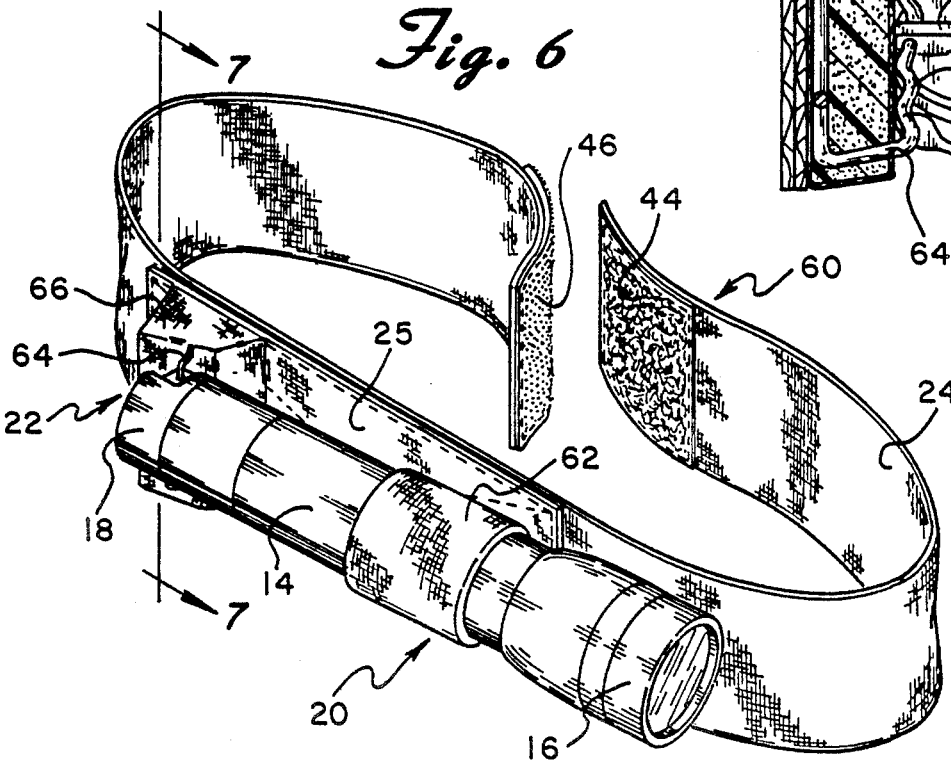
FIG. 6 is a perspective view of a second embodiment of my invention with a flashlight held thereon.

Device 60 illustrated in FIGS. 6 and 7 is identical in many respects to that of device 10. For the purposes of clarity, those parts of device 60 that are identical to that of device 10, will be identified by the same number. Holding device 20 and adjustment device 22 of flashlight holding device 60 are each different from that of device 10. In other respects, the devices are identical. Holding device 20 is constructed of elastic cloth tube 62 which is stitchably attached medially to section 25. The elasticity and diameter of tube 62 is chosen such that the body of flashlight 14 will be held securely when end 18 of the body is inserted therein. Adjustment device 22 includes block member 66 which is very similar to that of block 26 except that it is covered with cloth adhesively attached thereon. Clip 64 is spring steel with a major portion embedded in block 66 with one end of it extending outwardly through bearing surface 72 and bending and extending generally parallel to the bearing surface a length to a terminal end. That length section 68 positioned parallel to bearing surface 72 is formed in a corrugated shape having a plurality of reverse bends. Terminal end 70 of section 68 is inserted through hole 19 best shown in FIG. 5 extending transversely through flange 21 that extends radially outwardly from rear end section 18 of flashlight 14. With device 22, end 18 can be adjusted and positioned at varying heights along the length of corrugated section 68 and held in position by the spring nature of clip 64 against bearing surface 72 of block 66. In this way, the vertical direction of the beam of light emanating from front end 16 of flashlight 14 may be adjusted.

While this invention has been described with reference to the specific embodiments disclosed herein, it is not confined to the details set forth and the patent is intended to include modifications and changes which may come within and extend from the following claims.

I claim:

1. A device to hold a flashlight on the head of a person the flashlight comprising a tubular body, a front end from which a beam of light is emitted and a rear opposite end, the device comprising:

(a) a strap to fit around the person's head, (b) first means to adjust the size of the strap to firmly hold the strap horizontally around the person's head above the person's eyes, (c) holding means on the strap to hold the flashlight to the strap in a generally horizontal position on a side of the person's head, (d) a support member attached to the strap comprising an essentially vertical bearing surface facing away from the strap, wherein the support member is positioned rearwardly of the holding means a sufficient distance to allow the rear end of the flashlight to rest on the bearing surface when the flashlight is held in the holding means, and (e) vertical adjustment means to hold the rear end of the flashlight in any chosen position vertically on the bearing surface of the support member.

2. The device of claim 1 wherein the first means comprises that the strap is elastic.

3. The device of claim 1 wherein the first means comprises two ends of the strap overlapping each other and complimentary hook and loop fabric surface attachment swatches attached on mating overlapping ends of the strap.

4. The device of claim 1 wherein the holding means comprises:

(a) a band having two ends and a median section, which is attached to the strap in a vertical alignment, and (b) complimentary hook and loop fabric surface attachment swatches attached on opposite sides of the band and on opposite ends of the band.

5. The device of claim 1 wherein the support member is a block of rigid flexible polymeric plastic foam.

6. The device of claim 1 wherein the bearing surface is sloped frontwardly toward the strap in relation to the outside surface of the strap.

7. The device of claim 1 wherein the support member comprises a horizontal width sufficient to place the bearing surface a sufficient distance from the strap that the flashlight beam is focusable at a point on the line of sight of the person looking straight ahead.

8. The device of claim 1 wherein the vertical adjustment means comprises:

(a) a hook or loop fabric surface attachment swatch attached on the bearing surface of the support member, and (b) a complimentary hook or loop fabric surface attachment swatch attached on the rear end of the flashlight.

9. The device of claim 1 wherein the flashlight comprises a projection from the rear end with a hole through the projection, and the vertical adjustment means comprises a metal member formed in a corrugated pattern on one exposed end of a size and shape to interfit into the hole in the flashlight projection and the exposed end being attached in a vertical alignment to the support member abutting the bearing surface.

10. A device to hold a flashlight on the head of a person, the flashlight comprising a tubular body, a front end from which a beam of light is emitted and a rear opposite end with a projection from the rear end with a hole through the projection, the device comprising:

(a) a strap to fit around the person's head, (b) first means to adjust the size of the strap to firmly hold the strap horizontally around the person's head above the person's eyes, (c) holding means on the strap to hold the flashlight to the strap in a generally horizontal position on a side of the person's head, (d) a support member attached to the strap rearwardly of the holding means a sufficient distance to allow the rear end of the flashlight to rest on the bearing surface when the flashlight is held in the holding means, wherein the support member comprises an essentially vertical bearing surface facing away from the strap positioned a sufficient horizontal distance from the strap that the flashlight beam is focusable at a point on the line of sight of the person looking straight ahead, and (e) vertical adjustment means to hold the rear end of the flashlight in any chosen position vertically on the bearing surface of the support member comprising a metal member formed in a corrugated pattern on one exposed end of a size and shape to interfit into the hole in the flashlight projection and the exposed end being attached in a horizontal alignment to the support member abutting the bearing surface.

11. The device of claim 10 wherein the first means comprises that the strap is elastic.

12. The device of claim 10 wherein the first means comprises two ends of the strap overlapping each other and complimentary hook and loop fabric surface attachment swatches attached on mating overlapping ends of the strap.

13. The device of claim 10 wherein the holding means comprises:

(a) a band having two ends and a median section, which is attached to the strap in a vertical alignment, and (b) complimentary hook and loop fabric surface attachment swatches attached on opposite sides of the band and on opposite ends of the band.

14. The device of claim 10 wherein the support member is a block of rigid flexible polymeric plastic foam.

15. The device of claim 10 wherein the bearing surface is sloped frontwardly toward the strap in relation to the outside surface of the strap.

16. A method to hold a flashlight on the head of a person, the flashlight comprising a tubular body, a front end from which a beam of light is emitted and a rear opposite end, the device comprising:

(a) fitting a strap around the person's head, (b) adjusting the size of the strap to firmly hold the strap horizontally around the person's head above the person's eyes, (c) detachably attaching the flashlight to the strap using a holding means on the strap in a generally horizontal position on a side of the person's head, (d) resting the rear end of the flashlight on a an essentially vertical bearing surface of a support member attached to the strap rearwardly of the holding means, the position of bearing surface of the support member being a sufficient distance to allow the rear end to rest on the bearing surface while the flashlight is held in the holding means, (e) focusing the flashlight beam at a point on the line of sight of the person looking straight ahead, wherein the vertical bearing surface facing away from the strap is positioned a sufficient horizontal distance from the strap to allow said focusing, and (f) vertically adjusting the focus of the flashlight means by detachably attaching the rear end of the flashlight in any chosen position vertically on the bearing surface of the support member.

17. The method of claim 16 wherein vertically adjusting the focus of the flashlight comprises attaching a hook or loop fabric surface attachment swatch attached on the rear end of the flashlight to a complimentary hook or loop fabric surface attachment swatch on the bearing surface of the support member.

18. The method of claim 16 wherein the flashlight comprises a projection from the rear end with a hole through the projection, and vertically adjusting comprises attaching a metal member with a section formed in a corrugated pattern proximate an exposed end, the section being attached in a horizontal alignment abutting the bearing surface, and vertical adjusting further comprises interfiting the section into the hole in the flashlight projection.

* * * * *